United States Patent [19]

Ramig, Jr.

[11] 4,454,809

[45] Jun. 19, 1984

[54] PRINT HAMMER MECHANISM

[75] Inventor: Robert J. Ramig, Jr., Niles, Ill.

[73] Assignee: Teletype Corporation, Skokie, Ill.

[21] Appl. No.: 483,341

[22] Filed: Apr. 8, 1983

[51] Int. Cl.[3] ..... B41J 9/30

[52] U.S. Cl. ..... 101/93.30; 101/93.34; 101/93.29; 101/93.48

[58] Field of Search ..... 101/93.13, 93.14, 93.28, 101/93.29, 93.30, 93.31, 93.33, 93.34, 93.48, ; 400/370–374

[56] References Cited

U.S. PATENT DOCUMENTS

| | | | |
|---|---|---|---|
| 2,897,752 | 8/1959 | Malmros et al. | 101/93.30 |
| 3,152,540 | 10/1964 | Pensavecchia et al. | 101/93.30 |
| 3,177,803 | 4/1965 | Antonucci | 101/93.34 |
| 3,292,531 | 12/1966 | Mutz | 101/93.30 |
| 3,335,659 | 8/1967 | Schacht et al. | 101/93.34 |
| 3,795,187 | 3/1974 | Babler | 101/93.30 |
| 3,929,067 | 12/1975 | Nishikawa et al. | 101/93.30 |
| 4,109,776 | 8/1978 | Elk et al. | 101/93.34 |

FOREIGN PATENT DOCUMENTS

| | | | |
|---|---|---|---|
| 124682 | 9/1980 | Japan | 101/93.29 |

*Primary Examiner*—Edgar S. Burr
*Assistant Examiner*—John A. Weresh
*Attorney, Agent, or Firm*—W. K. Serp

[57] ABSTRACT

A print hammer mechanism 10 includes a plurality of parallel print hammers positioned for sliding movement within slots 20*a–i*, 22*a–i* in the walls 16, 18 of a frame 12. The selective energization of one of a plurality of magnets 61*a–i* draws the corresponding hammer 30*a–i* against a rotating roller 52. The roller 52 drives the print hammer from a rest position to a print position. At the print position, a head 40*a–i* on the selected hammer 30*a–i* forces a paper medium against a type die 64 with an ink ribbon 62 interposed. Return movement is provided by a coil spring 38*a–i* attached to the rearward end of the hammer 30*a–i.*

4 Claims, 4 Drawing Figures

PRINT HAMMER MECHANISM

DESCRIPTION

1. Technical Field

This invention relates to a print hammer mechanism for an alphanumeric line printer.

2. Background Art

A type of line printer currently in use includes several print hammers arranged in a row along a print station. Moveable type dies are carried on a belt in proximity to the print hammers. When the desired type die is positioned at a selected character location on the printing line, a corresponding print hammer is actuated. The print hammer presses the paper and an interposed ink ribbon against the selected type die thus printing the desired character. The print hammer drive mechanism must quickly and positively engage and drive the hammers against the type die. U.S. Pat. No. 3,929,067 entitled "Impact Printer" and issued Dec. 30, 1975 to Nishikawa et al. describes a print hammer mechanism which includes a rack integral with a print hammer which is meshed with the teeth of a gear. The gear is selectively engaged to a rotating shaft by an electromagnetic clutch. Upon de-engergization of the clutch, the hammer is returned to its initial position by a return spring. The rotary clutch, rack and gear mechanisms are relatively expensive to manufacture. Additionally, the return movement of the hammer is slow since the rack, when returning to the rest position, is maintained in engagement with the gear thus introducing considerable friction and drag.

Still another device is illustrated in U.S. Pat. No. 3,292,531 entitled "Printing Hammer Arrangement" Issued Dec. 20, 1966 to G. Mutz. The Mutz device utilizes a rotating toothed wheel. A hammer, with an inegral pawl, is forced against the wheel in response to energization of an electromagnet. As the wheel rotates, the pawl abruptly engages a gear tooth driving the hammer against a type die. The abrupt engagement of the pawl and wheel introduces considerable wear and the arrangement results in relatively noisy operation. In the event the hammer becomes temporarily jammed, breakage of the pawl and/or wheel may occur. Prior print hammer mechanisms have generally included complex and thus expensive apparatus for coupling the hammer to a driver. Such arrangements have often included a positive engagement mechanism resulting in high wear and potential breakage.

DISCLOSURE OF THE INVENTION

In accordancae with this invention, a print hammer mechanism includes an elongated hammer moveable along a linear path from a rest position to a print position. The hammer is biased to its rest position by a first means. A drive roller is rotatably mounted at a position adjacent to and spaced from the hammer. Means are included for driving the roller and second means are provided for biasing the hammer against the surface of the drive roller. Thus, upon engagement with the drive roller, the hammer is driven along the linear path from the rest position to the print position.

Preferably, the second biasing means includes an electromagnet selectively energized for attracting the hammer and biasing it against the drive roller. Means are included for limiting the movement of the hammer toward the magnet to prevent physical contact between the hammer and the magnet when the magnet is energized. The illustrated embodiment provides a print head actuating mechanism which is relatively simple and economical to construct and does not experience high wear.

DRAWINGS

DETAILED DESCRIPTION

Figure 1:
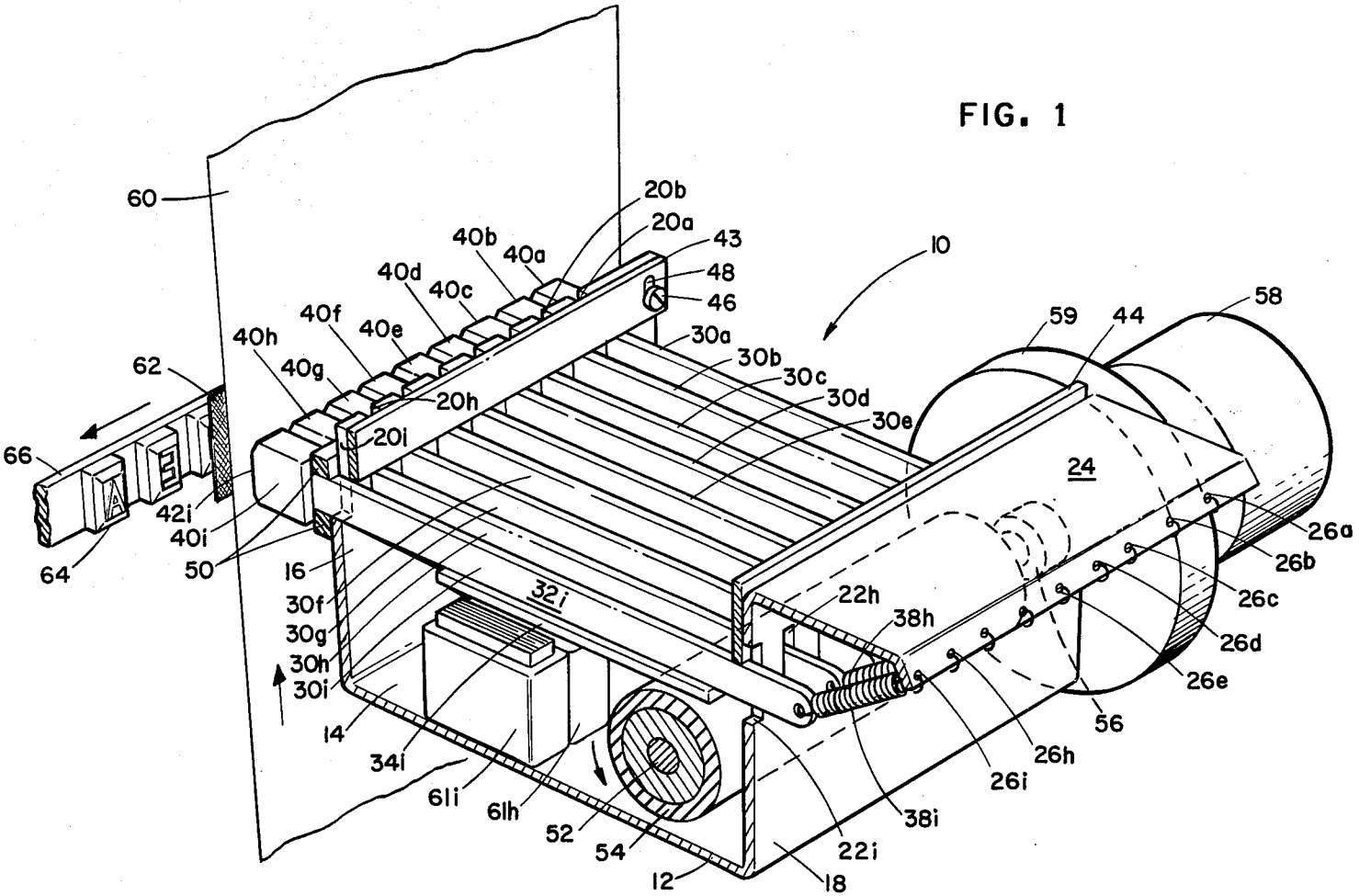
FIG. 1 is a perspective view of a portion of a printer incorporating a print hammer mechanism embodying features of this invention.

The print hammer mechanism 10, illustrated in FIG. 1, includes a U-shaped support frame 12 having a flat base 14 and front and rear parallel walls 16 and 18. The upwardly disposed end of the front wall 16 has a plurality of spaced hammer guide slots 20*a–i*. The rear wall 18 has a plurality of similarly shaped slots 22*a–i*. The upper end of the rear wall 18 is bent to form a ledge 24 projecting outwardly with the end of the ledge 24 angled downwardly and having a plurality of spaced holes 26*a–i* each of which corresponds to one of the slots 22*a–i* in the rear wall 18.

Positioned within each pair of cooperating guide slots 20*a–i*, 22*a–i* is a print hammer 30*a–i*. For purposes of discussion, one print hammer 30*i* will be described in detail with the remaining print hammers 30*a–h* being similarly constructed. The print hammer 30*i* includes a flat elongated body member 32*i* which is positioned in the aligned slots 20*i*, 22*i* for guidance along a path determined by the slots. Secured to the lower edge of the body member 32*i* is a steel plate 34*i* which is attracted by a magnetic field as will be further considered. Urging the hammer 30*i* toward the rear wall 18 is a coil return spring 38*i*. One end of the coil spring 38*i* is hooked to the end of the body member 34*i*, and the remaining end of the coil spring 38*i* is hooked to a corresponding hole 26*i* in the shelf 24. Mounted to the forward end of the body member 30*i* is an enlarged hammer head 40*i* which is rectangular in shape and has a forward print surface 42*i*.

The hammers 30*a–i* are positioned and maintained within the slots 20*a–i*, 22*a–i* by forward and rear guide plates 43, 44. The forward guide plate 43 is secured to the front wall 16 of the frame 12 by screws 46 which pass through elongated holes 48 in the guide plate 43 and thread into cooperating holes in the front wall 16. The opposite ends of the body members 30*a–i* are similarly positioned by the rear guide plate 44 adjustably secured to the rear wall 18 of the frame 12. Secured by adhesive to the outer surface of the forward wall 16 are a pair of parallel resilient bumper strips 50 which absorb the return force of the hammers 30*a–i*.

Forward driving force is selectively delivered to each of the hammers 30*a–i* by a rotating drive roller 52. The roller 52 is coated with a material 54 having a high frictional coefficient with the surface of the plates 34*a–i*. The roller 52 is supported by a bearing 56 mounted upon a side wall (not shown) of the frame 12 and driven by a drive motor 58. A fly wheel 59 supplies inertia to the rotating drive roller 52.

Figure 2:
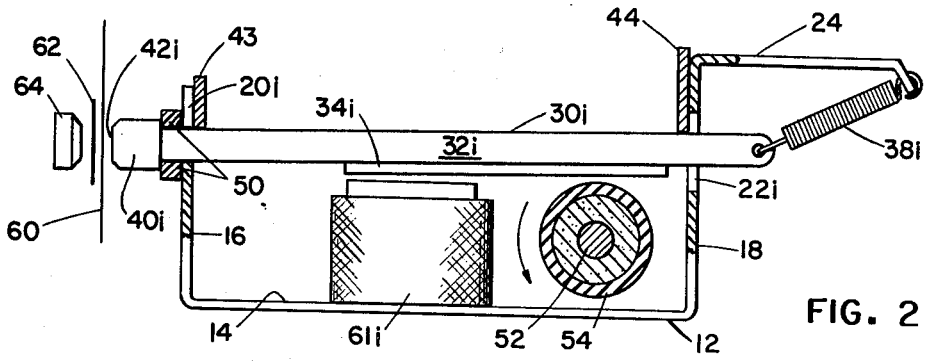
FIG. 2 is an end view of FIG. 1 illustrating a first position of a hammer of the print hammer mechanism of FIG. 1.
Figure 3:
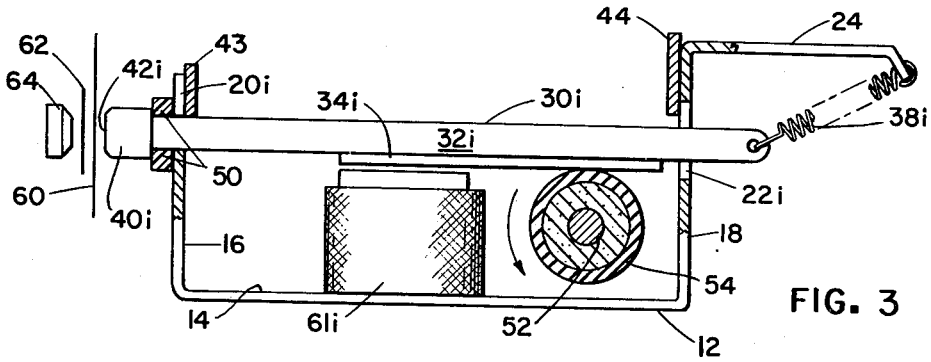
FIG. 3 is a sectional view similar to that of FIG. 2 illustrating a second position of a hammer of the print hammer mechanism of FIG. 1.
Figure 4:
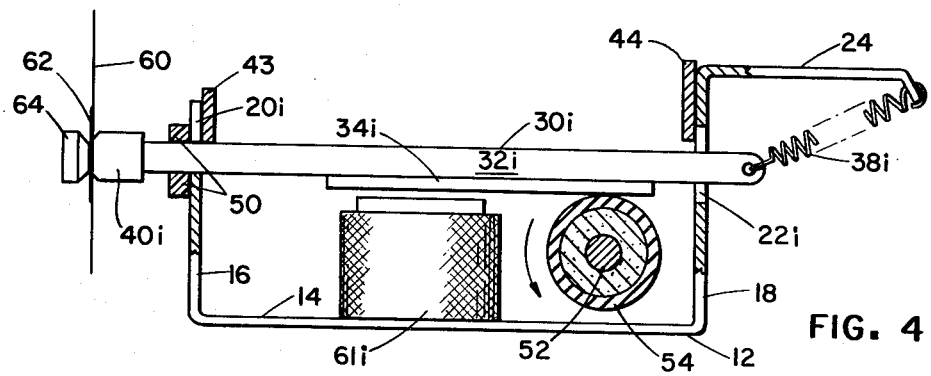
FIG. 4 is a sectional view similar to that of FIG. 2 illustrating a third position of a hammer of the print hammer mechanism of FIG. 1.

As illustrated, when the hammer body members 32*a–i* are positioned within the slots 20*a–i*, 22*a–i* of the frame 12, the corresponding return springs 38*a–i* bias the respective hammers 30*a–i* to their rearward or rest position away from the roller 52. In this position, the roller 52 is free to rotate. The hammer mechanism 10 additionally includes a plurality of magnets 61*a–i* each of which is selectively energized to draw the associated body member toward the roller 52. The positions of the guide members 43, 44 are adjusted to assure that adequate clearance exists between the roller 52 and the plates 34*a–i*. The plates 34*a–i* are positioned sufficiently close to the magnets 61*a–i* to assure movement of the hammers 30*a–i* when the corresponding magnet 61*a–i* is energized. The depth of the slots 20*a–i* and the position of the magnets 61*a–i* and roller 52 is selected so that the plates 34*a–i* will engage the surface of the roller 52 before contacting the magnet 61*a–i* thereby eliminating sliding friction between the plates 34*a–i* and magnets 61*a–i* during the printing operation. Upon engagement, the selected hammer 30*a–i* is driven by the roller 52 toward a paper medium 60 which is forced against a selected type die 64 with an ink ribbon 62 positioned between the type die 64 and paper medium 60. The type dies 64 are carried upon a continuously moving belt 66 with the selected hammer 30*a–i* energized when the appropriate die 64 is aligned with the hamer 30*a–i* in accordance with timing arrangements well known in the art. One such control system is described in U.S. Pat. No. 3,845,710 issued to Brodrueck on Nov. 5, 1974 and entitled "Print Control Logic Circuitry for On-The-Fly Printers". In FIGS. 2,3 and 4, the print hammer 30*i* is illustrated in successive operating positions. In FIG. 2, the magnet 36 is de-energized; and the hammer 30*i* is in its rest position with the plate 34*i* spaced from the drive roller 52. In this position, the driven roller 52 freely rotates. In response to an appropriate control signal, the magnet 61*i* is energized drawing the plate 34*i* toward the drive roller 52 and against the bias of the return spring 38*i*. It should be noted that the plate 34*i* strikes the surface of the roller 52 and the bottom of the slot 20*i* before it engages the magnet 61*i*. This feature is particularly desirable in that it prevents contact between the surface of the magnet 61*i* and the plate 34*i*. Such contact would produce friction which could be sufficient to interfere with the operation of the hammer 30*i* or alternatively require a considerable power increase in the motor 58. In FIG. 3, the print hammer 30*i* is shown in its print position whereat the head 40*i* of the hammer 30*i* forces the paper medium 60 against an ink ribbon 62 and type die 64. Upon de-energization, the magnet 61*i* releases the hammer 30*i*; and the hammer 30*i* is returned to its initial position (FIG. 2) in response to bias of the return spring 38*i* with the bumper strips 50 absorbing the return force of the hammer 30*i*. The spacing between the plate 34*i* and the roller 52 as well as the spacing between the magnet 61*i* and plate 34*i* is adjusted by positioning the plates 43 and 44.

While this invention has been particularly shown and described in connection with an illustrated embodiment, it will be appreciated that various changes may be made without departing from the spirit and scope of the invention as set forth in the following claims.

What is claimed is:

1. A print hammer mechanism (10) for a printer comprising:

a print hammer (30*a–i*) including an elongated body member having a print head secured to one end thereof said body member moving axially along a generally linear path from a rest position to a print position, said body member having an elongated driving surface the longitudinal axis of said elongated driving surface being parallel to the longitudinal axis of said body member, said driving surface being positioned for movement along said generally linear path from said rest position to said print position;

first means for biasing said hammer toward said rest position;

a friction drive roller (52) with a generally smooth outer surface having a high frictional coefficient with said driving surface and rotatably mounted at a position adjacent to and spaced from said driving surface of said body member, the axis of said drive roller being generally normal to the path of movement of said body member driving surface;

means (58) for rotatably driving said roller (52);

a selectively energizable electromagnet (61*a–i*) for selectively biasing said elongated driving surface of said body member toward said electromagnet and against the outer surface of said rotating drive roller (52) so that upon engagement with said outer surface of said rotating drive roller by said drive surface, said hammer body member (30*a–i*) will be driven from said rest position to said print position along said linear path by frictional engagement of said drive surface and said roller;

said body member of said print hammer (30*a–i*) includes an elongated steel drive plate defining said driving surface (34*a–i*) and positioned within the magnetic field generated by said electromagnet (61*a–i*); and means for limiting the movement of said hammer (30*a–i*) towards said electromagnet (61*a–i*) in response to the energization thereof to prevent physical contact between said steel drive plate (34*a–i*) and said electromagnet (61*a–i*).

2. The print hammer mechanism of claim 1 wherein said first biasing means (38*a–i*) includes a coil spring secured between a second end of said body member (32*a–i*) of said hammer (30*a–i*) and a support frame (12) and urging the hammer (30*a–i*) to its rest position.

3. The print hammer mechanism of claim 2 wherein said print head (40*a–i*) is enlarged in comparison to the hammer body member (32*a–i*); and a bumper (50) of resilient material is positioned to stop and absorb the return force of said hammer head (40*a–i*) when the hammer (30*a–i*) is returned to its rest position under bias of said return spring (38*a–i*).

4. The print hammer mechanism of claim 3 which further comprises means for adjusting the relative position of said body member (32*a–i*) with respect to said magnet (61*a–i*) and thus the path of movement of said print hammer (30*a–i*).

* * * * *